United States Patent [19]

Hensley

[11] Patent Number: 4,495,963

[45] Date of Patent: Jan. 29, 1985

[54] REMOTELY ACTUATED OIL DRAIN FOR MOTOR VEHICLES

[76] Inventor: William H. Hensley, 6745 E. Boston St., Mesa, Ariz. 85205

[21] Appl. No.: 462,219

[22] Filed: Jan. 31, 1983

[51] Int. Cl.[3] ..... F16L 3/00

[52] U.S. Cl. ..... 137/351; 251/144; 251/293; 184/1.5

[58] Field of Search ..... 251/293, 89, 144, 279; 137/351, 354, 385; 184/1.5; 192/71

[56] References Cited

U.S. PATENT DOCUMENTS

| | | | |
|---|---|---|---|
| 400,944 | 4/1889 | Powell | 251/293 |
| 1,322,979 | 11/1919 | Waite | 251/293 |
| 1,665,288 | 4/1928 | Taylor | 251/293 |
| 2,509,426 | 5/1950 | Fransen | 251/293 |
| 2,621,494 | 12/1952 | Cross | 192/71 |
| 2,657,705 | 11/1953 | Gerhard et al. | 137/351 |
| 3,097,663 | 7/1963 | Buchwald | 137/351 |
| 3,310,133 | 3/1967 | Eaker | 184/1.5 |
| 3,650,352 | 3/1972 | Schwary | 184/1.5 |
| 3,954,250 | 5/1976 | Grace | 251/144 |
| 4,086,981 | 5/1978 | Mitsui | 184/1.5 |
| 4,319,664 | 3/1982 | Price et al. | 184/1.5 |
| 4,361,310 | 11/1982 | Cummins | 137/351 |

*Primary Examiner*—Martin P. Schwadron
*Assistant Examiner*—Sheri Novack
*Attorney, Agent, or Firm*—Joseph H. Roediger

[57] ABSTRACT

An inexpensive owner installable remotely controlled drain valve for the crankcase of a motor vehicle utilizing a valve having a rotatable stem therein. Rigid extensions with universal joints therebetween are coupled between the valve stem and a locking means located under the hood of the vehicle. Rotation of the free end of the device opening and closing the valve to permit controlled drainage of the crankcase.

8 Claims, 6 Drawing Figures

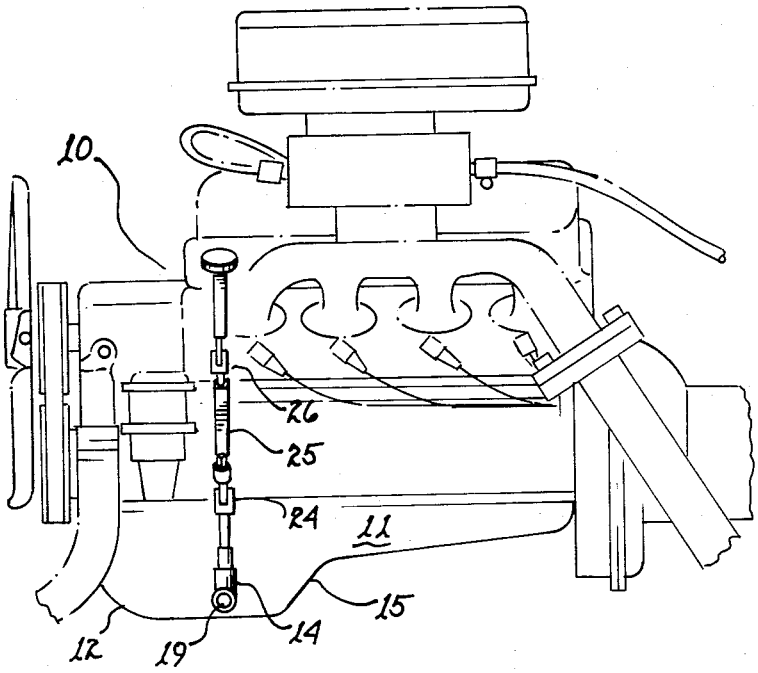
fig. 1
fig. 3
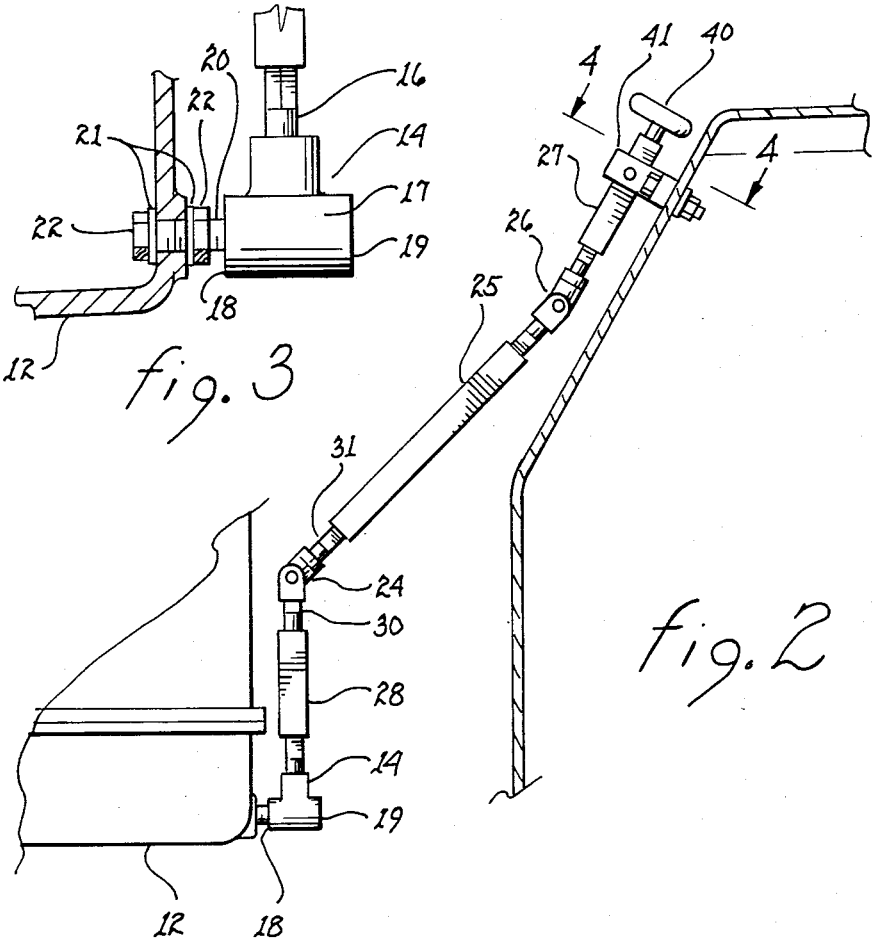
fig. 2

REMOTELY ACTUATED OIL DRAIN FOR MOTOR VEHICLES

BACKGROUND OF THE INVENTION

The present invention relates to remotely actuated means for draining oil from a motor vehicle crankcase.

As the costs of purchasing and maintaining motor vehicles have increased considerably over the past few years, interest has risen on the part of vehicle owners in performing themselves many of the service tasks which prolong the operating life of the vehicle. Among the many tasks that the owner can do for himself is the periodic draining and changing of the motor oil. Since the drain plug is located near or on the bottom surface of the crankcase in original equipment purchased from manufacturers, the draining of a crankcase on a new motor vehicle requires two trips under the car at one of its lower points to first remove the drain plug and then to reinstall it.

Over the years, a variety of remotely actuated devices have been proposed for oil changes by the vehicle operator. Common to these devices has been the use of a flexible cable attached to a spring-loaded or otherwise normally biased-closed valve installed in the oil sump. The valve is actuated by cable tension with the cable end being available either at the vehicle instrument panel or accessible under the hood.

In practice, these devices are expensive to manufacture, normally require elaborate locking mechanisms to prevent erroneous actuation and frequently cannot be installed by the typical vehicle owner. Furthermore, the valve responsive to push-pull cable actuation has a spring-loaded arm which closes the valve upon release of the cable tension. Thus, the user does not directly effect closure through a positive application of force. This leads to uncertainty of complete closure over long periods of usage.

In addition, the character of spring-loaded valves changes over a period of time especially when the spring experiences repeated temperature cycling due to its location in proximity to the engine block. Also, the repeated actuation of the valve biasing spring may effect changes in the restoring or closure forces exerted thereby. To alert the vehicle operator of an improperly or not fully closed valve, many proposed remote drain systems have electrical warning systems including dashboard indicator lights associated therewith. The cost, complexity of installation and lack of reliability of the prior devices have limited their adoption by vehicle owners.

Accordingly, the present invention is directed to the provision of a remotely actuated oil drain device for motor vehicles in which the valve used is subjected to a positive closure force exerted by the operator. This force is intentionally made rotational to improve the reliability of the device. A further objective of this invention is to provide a simplified device that is relatively inexpensive to manufacture and to install. Thus, the ratio of benefit to cost of the present invention is such as to enable the user to realize a net saving from the use of the invention within a reasonable period of time.

SUMMARY OF THE INVENTION

This invention concerns apparatus for permitting the remote actuation of a drain valve for changing the oil in a motor vehicle crankcase. The apparatus includes valve means having an extension adapted for insertion into a crankcase and an actuating stem the rotation of which actuates the valve. The valve, typically a gate or ball valve, is directly responsive to the rotational force applied to the stem.

A universal joint having opposing arm extensions is coupled between a rigid motion translating arm and the valve stem. The application of a rotational force to the translating arm is directly applied to the valve stem and rotates the valve between its open and closed positions. The use of the universal joint permits a rigid force translating arm to be employed at different positions for different vehicles. In addition, receiving means is affixed to the vehicle under the hood for removably receiving the translating arm therein and preventing rotation thereof.

In many vehicles the invention includes a second universal joint along with a second motion translating arm affixed thereto. The universal joints are provided with extension arms having rectangular cross-sectional areas and the motion translating arms are formed of hollow rectangular stock which permit ready assembly by the user. Also, the use of a rectangular translating arm enables the use of a generally U-shaped receiving means for retaining the free end of the arm and preventing undesired rotation thereof.

Further features and advantages of the invention will become more readily apparent from the following detailed description of the preferred embodiment of the invention when taken in conjunction with the accompanying drawings.

BRIEF DESCRIPTION OF THE DRAWINGS

FIG. 1 is a side view of a typical motor vehicle engine with one embodiment of the invention installed thereon;

FIG. 2 is a front view of the embodiment of FIG. 1 showing the receiving means affixed to the body of the motor vehicle;

FIG. 3 is an enlargement of the valve of FIG. 2;

DESCRIPTION OF THE PREFERRED EMBODIMENT

Figure 4:
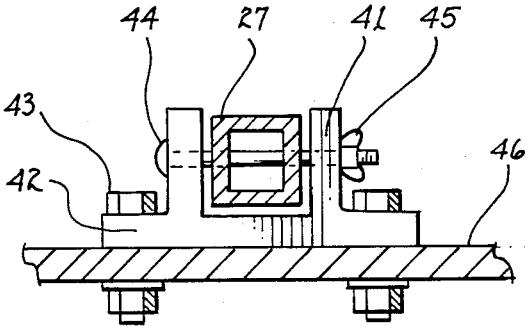
FIG. 4 is a top view of the receiving means taken along line 4—4 of FIG. 2.

Referring now to FIG. 1, a motor vehicle engine 10 is shown in side view with the crankcase 11 located at its underside. The crankcase serves as the reservoir for the motor's lubricating oil and includes a lower portion 12 that typically contains a conventional oil drain plug (not shown) on its underside.

A drain valve 14, shown also in FIGS. 2 and 3, is mounted in the side of lower portion 12. The actuation of this valve provides the draining function of the present invention. While it is shown located on the side of the lower portion 12 of the crankcase 11 as is typical of installations in automobiles wherein the underside of the crankcase is close to being located at the lowest portion of the vehicle, many truck vehicles have suspension systems that extend beneath the crankcase and provide protection thereto. In this type of application, valve 14 is preferably mounted on the rear face 15 of the lower portion of the crankcase where it may extend downwardly at an angle to beneath the lower surface of crankcase 11. The location of the drain valve can be varied to accommodate the particular crankcase shape of the motor vehicle as long as it is mounted at or near the lowest portion of the oil sump. The ease of installation and the universality of application are important features of the present invention.

The drain valve utilized in this invention is characterized by a stem 16 extending out of the valve housing 17. The valve which is a conventional ball or gate valve is opened and closed in response to the rotation of the valve stem 16. The opening of the valve provides a fluid passage between input orifice 18 and output orifice 19. The input orifice is coupled to a standard nipple 20, typically three-eighths of an inch internal diameter, which extends into a hole in the crankcase. The nipple is a conventional threaded section of pipe and is affixed to the wall of the crankcase by the internal and external combinations of a gasket 21 and threaded fastener 22.

The installation of the invention requires the removal of the lower half of the crankcase, the drilling of a hole therein at or near the lowermost portion of the crankcase with an orientation determined by the characteristics of the vehicle followed by the insertion of the threaded nipple. A washer-fastener combination is placed on either side of the crankcase wall to provide a seal. The crankcase is reassembled and the valve 14 is then threaded onto the exposed end of the nipple. As previously noted, the valve state is determined by rotation of the stem 16 and in practice, a one-quarter turn is sufficient to change its state from open to closed. By the use of a rotationally-responsive valve means 14, no actuating means relying on biasing forces generated by mechanisms located within this region of the vehicle are necessary. The valve directly responds to external forces for both opening and closure. Thus, the state of the valve can be determined by and is under the direct control of the remotely located user of the invention.

In order to provide for the transmission of a remotely applied rotational force through a low-cost, reliable assembly, the invention utilizes a conventional universal joint 24 affixed between the valve 14 stem, and at least one rotational motion translating arm 25. Since the apparatus is to be utilized with cars and trucks of different engine compartment clearances and dimensions, it is often required that a second universal joint 26 and second rotational motion translating arm 27 be utilized. This enables the invention to be located under the hood of the engine compartment and available to the user without requiring the user to extend his arm deep into the engine compartment to operate the invention.

Figure 5:
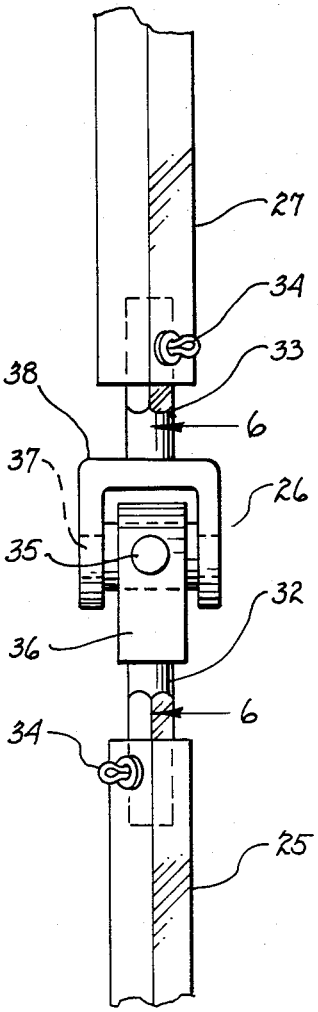
FIG. 5 is an enlargement of the second universal joint of the embodiment of FIG. 1.

The low-cost assembly and manufacture features of the invention are obtained through the use of a rectangular ended valve stem 16 to which the first extension arm 30 of universal joint 24 is coupled. The coupling 28 between arm 30 and valve stem 16 is a section of hollow rectangular bar-stock adapted to receive the valve stem and the rectangular cross-section of arm 30. The entire assembly is shown comprising rectangular extension arms for the joints and hollow rectangular translating arms therebetween. Although the embodiment of FIGS. 2 and 3 shows that frictional engagement between adjacent parts can be used in the assembly, FIG. 5 shows the use of washers and fasteners 34 to insure that the different parts are maintained in their affixed positions during continued usage.

Figure 6:
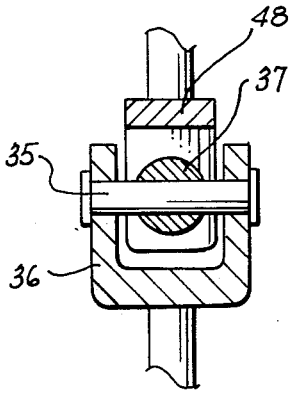
FIG. 6 is a view in section taken along line 6—6 of FIG. 5.

The universal joint 26 is provided with extension arms 32, 33 which are slidably received in hollow translating arms 25, 27 respectively. While rectangular cross-sections are used in the preferred embodiment, other cross-sectional shapes may be utilized as long as there is resistance to relative rotation between adjacent parts. It shall be noted from FIGS. 5 and 6 that the universal joint 26 provides movement about two orthogonal axes defined by axial members 35 and 37 retained in corresponding U-shaped members 36 and 38. The universal joint is a known commercial item and different types may be utilized in connection with the present invention.

The free end of second translating arm 27 is provided with a handle 40 for the convenience of the user as seen in FIG. 2. In addition, a U-shaped bracket 41 shown in FIGS. 2 and 4 is affixed to the vehicle at a convenient location under the hood for removably receiving the translating arm 27 and preventing rotation thereof when so received. The U-shaped member includes a base 42 affixed by bolts 43 to the vehicle 46, preferably on the side of the engine compartment proximate to the wheel housing for ease of installation. The upstanding portions of bracket 41 are spaced to receive the cross-section of arm 27 and when so received prevent its removal by means of locking pin 44 and wingnut 45. The arm 27 is thus secured during operation and prevented from rotation by the bracket and the pin.

In operation, the individual places the appropriate receptacle under the drain valve, removes the locking pin 44 and rotates handle 40. The rotational force is transmitted via the arms and universal joints directly to the stem of the drain valve thereby effecting a positive opening for drainage. A positive closure is obtained by the user rotating the handle in the opposite direction. Then, the arm is stowed in the bracket and restrained from rotational movement by the bracket and from lateral movement by the locking pin. There is no reliance on automatic closure means not directly controlled by the user with the device.

While the above description has referred to a specific embodiment of the invention it is recognized that variations and modifications may be made therein without departing from the scope of the invention as claimed.

I claim:

1. Apparatus mounted within the engine compartment of a motor vehicle for the remote actuation of a drain valve for the engine crankcase of said motor vehicle which comprises:

(a) valve means having an extension adapted for insertion into a crankcase, said valve means having an actuating stem extending outwardly of said crankcase, the rotation of said stem actuating said valve;

(b) a first universal joint coupled to said valve stem for imparting rotation thereto;

(c) means for connecting said first U-joint to the portion of said valve stem extending outwardly of said crankcase;

(d) a first rigid motion translating arm having first and second ends, said first end being secured to said first universal joint; and (e) receiving means mounted within the engine compartment of said motor vehicle remote from said crankcase for removably receiving the second end of said arm and preventing rotation thereof, the removal of said arm from the receiving means and the rotation thereof actuating said valve means to permit the remote draining of the engine crankcase.

2. The apparatus of claim 1 further comprising a second universal joint affixed to the second end of said first arm, a second rigid motion translating arm having first and second ends with said first end being secured to said second universal joint, said receiving means removably receiving the second end of said second arm and preventing rotation thereof.

3. The apparatus of claim 2 wherein said first universal joint is provided with opposing extensions, one of said extensions being adapted for attachment to said actuating stem, the other of said extensions receiving the first end of said first arm.

4. The apparatus of claim 3 wherein the second end of said second arm is provided with a rectangular cross-sectional area, and said receiving means is generally U-shaped for receiving the rectangular portion of said second arm and preventing rotation thereof.

5. The apparatus of claim 4 wherein the receiving means is fixedly mounted within the engine compartment of the motor vehicle.

6. The apparatus of claim 5 further comprising locking means contained within the engine compartment of the motor vehicle for fastening the rectangular portion of said second arm in said receiving means to thereby prevent movement of said second arm during vehicle operation.

7. The apparatus of claim 6 wherein the actuating stem of said valve means has a rectangular cross-sectional area and the corresponding extension of said first universal joint has a similar cross-sectional area to permit attachment thereto.

8. The apparatus of claim 7 wherein said first and second arms are hollow rigid members with rectangular cross sections adapted to receive the universal joints therein, the rectangular members preventing relative rotation therebetween.

* * * * *